US009635478B1

(12) United States Patent
Mazanec

(10) Patent No.: US 9,635,478 B1
(45) Date of Patent: Apr. 25, 2017

(54) COULOMB COUNTER AND BATTERY MANAGEMENT FOR HEARING AID

(75) Inventor: Paul R. Mazanec, Blaine, MN (US)

(73) Assignee: ENVOY MEDICAL CORPORATION, St. Paul, MN (US)

( * ) Notice: Subject to any disclaimer, the term of this patent is extended or adjusted under 35 U.S.C. 154(b) by 697 days.

(21) Appl. No.: 13/444,527

(22) Filed: Apr. 11, 2012

(51) Int. Cl.
*H04R 25/00* (2006.01)

(52) U.S. Cl.
CPC ..... *H04R 25/70* (2013.01)

(58) Field of Classification Search
CPC ..... H04R 25/505
USPC ..... 381/320, 314, 312
See application file for complete search history.

(56) References Cited

U.S. PATENT DOCUMENTS

| | | | | |
|---|---|---|---|---|
| 6,308,101 | B1 * | 10/2001 | Faltys et al. | 607/57 |
| 8,055,343 | B2 | 11/2011 | Gandhi et al. | |
| 2008/0097544 | A1 * | 4/2008 | Gandhi et al. | 607/29 |
| 2009/0291658 | A1 * | 11/2009 | Castle | 455/255 |

* cited by examiner

*Primary Examiner* — Duc Nguyen
*Assistant Examiner* — Phan Le
(74) *Attorney, Agent, or Firm* — Seager, Tufte & Wickhem, LLP

(57) ABSTRACT

A hearing aid output amplifier additionally outputs a scaled replica of the output battery current, which is integrated and measured by a coulomb counter. The scaled current charges a capacitor. When the capacitor reaches a threshold voltage, a switch is activated. The switch rapidly discharges the capacitor and allows the charging cycle to begin again. The switch also sends a digital pulse to a digital counter, which keeps track of the number of charge/discharge cycles the capacitor has undergone over the lifetime of the device. The amount of charge produced by the battery is proportional to the number of charge/discharge cycles counted. A hearing aid is disclosed, which has different modes that have different dynamic ranges, such as a "sleep" mode, an "active" mode, and/or an "RF communication" mode.

15 Claims, 4 Drawing Sheets

COULOMB COUNTER AND BATTERY MANAGEMENT FOR HEARING AID

TECHNICAL FIELD

The present invention pertains to hearing aids, and methods for manufacturing and using such hearing aids.

BACKGROUND

Hearing restoration or compensation devices, commonly known as hearing aids, provide a tremendous benefit to a patient with congenital hearing loss or whose hearing has deteriorated due to age, genetics, illness, or injury. There is a wide variety of commercially available devices that can be worn externally or can be implanted within the body of the patient.

In an implantable hearing aid or other implantable medical device, it is generally important to know the status of the battery charge. If the battery were to drain beyond a particular threshold, it might lead to a failure of the device. For a hearing aid, such a failure would result in silence for the user. For other medical devices, a loss in service might have more severe consequences. As a result, many implantable devices include a mechanism to alert the user when the battery charge is low.

One of the simplest alert mechanisms uses a measure of the battery voltage. If the battery voltage dips below a predetermined threshold, then the user is alerted. However, this simple alert mechanism works only if the battery voltage decays as the battery is drained. For many implantable medical devices, the battery is designed to maintain a nearly flat voltage over the lifetime or the cycle of the battery. This flat voltage profile typically simplifies the design of the internal electronics, but usually prevents using the battery voltage itself to determine the remaining charge in the battery.

Another alert mechanism, which does not rely on the battery voltage directly, uses a circuit commonly known as a "charge integrator" or a "coulomb counter". For a simple coulomb counter, a resistor is placed in series with one of the battery terminals, and current flowing through the resistor is inferred by measuring the voltage across the resistor. The coulomb counter circuit acts like an integrator, so that the voltage across the resistor is measured over time and therefore represents a quantity that is proportional to a time integral of the current flowing through the resistor. Such a time-integrated current is the cumulative electrical charge that has flowed through the resistor. One can then compare the cumulative electrical charge detected by the circuit with the fully-charged capacity of the battery, and alert the user when the percentage of capacity reaches a particular threshold.

The simple coulomb counter runs into difficulty for devices that have a wide dynamic range of operating current, such as implantable hearing aids. The output power of an implantable hearing aid varies with the ambient sound environment around a user, and can vary over a dynamic range between 60 dB and 80 dB. Specifically, the problem with such a large dynamic range arises from the resistor that is in series with one of the battery terminals. If a resistance value is chosen to accommodate large currents (corresponding to loud volumes), then at low volumes the voltage drop across the resistor is too small to be measured practically. If a resistance value is chosen to accommodate small currents (corresponding to low volumes), then at loud volumes the voltage drop across the resistor may be large and may lead to excessive power dissipation and/or heating at the resistor. Neither of these conditions is desirable.

Accordingly, there exists a need for a mechanism in an implantable hearing aid that can alert the user when the battery charge is low. Such a mechanism may also be used in other power-monitoring applications that have a large dynamic range.

BRIEF SUMMARY

An embodiment is a hearing aid for a patient. A sensor converts ambient sound around the patient into an input electrical signal. An output amplifier produces a primary output electrical signal in response to the input electrical signal and produces a secondary output electrical signal that is a scaled version of the primary output electrical signal. A driver receives the primary output electrical signal and stimulates an anatomy of the patient. An oscillator receives the secondary output electrical signal and oscillates each time that a predetermined amount of electrical charge is received in the secondary output electrical signal. A digital counter increments each time the oscillator oscillates.

Another embodiment is a method of monitoring a battery charge in a hearing aid, comprising: producing a scaled replica of a primary output electrical signal; and directing the scaled replica to a coulomb counter.

The above summary of some embodiments is not intended to describe each disclosed embodiment or every implementation of the present invention. The Figures, and Detailed Description, which follow, more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
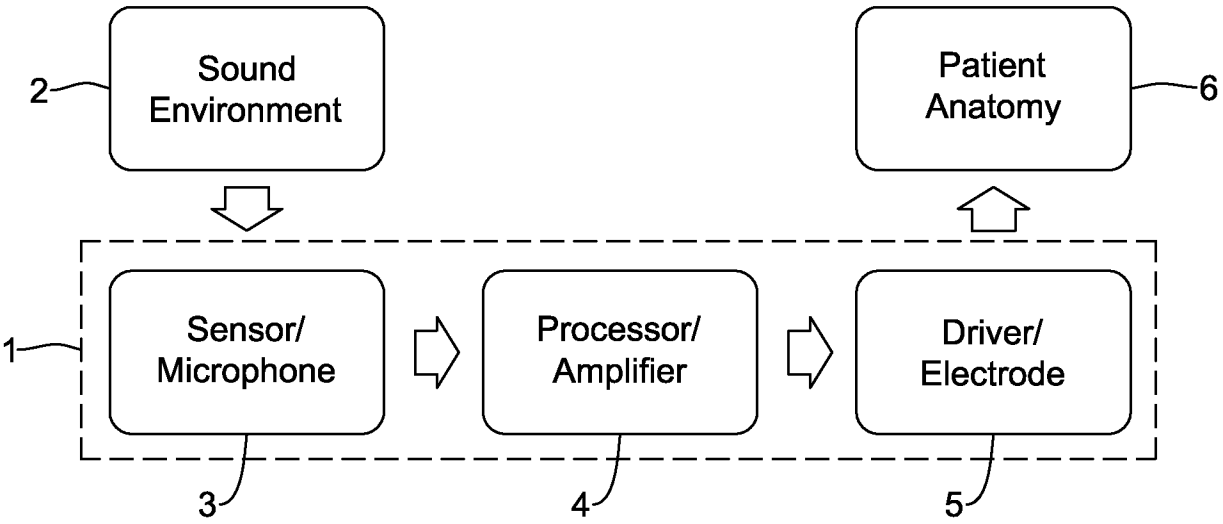
FIG. 1 is a block diagram of an implantable hearing restoration device.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

For the purposes of this document, the term "hearing aid" is intended to mean any instrument or device designed for or represented as aiding, improving or compensating for defective human hearing and any parts, attachments or accessories of such an instrument or device.

A hearing aid output amplifier additionally outputs a scaled replica of the output battery current, which is integrated and measured by a coulomb counter. The scaled current charges a capacitor. When the capacitor reaches a threshold voltage, a switch is activated. The switch rapidly discharges the capacitor and allows the charging cycle to begin again. The switch also sends a digital pulse to a digital counter, which keeps track of the number of charge/discharge cycles the capacitor has undergone over the lifetime of the device. The amount of charge produced by the battery is proportional to the number of charge/discharge cycles counted. A hearing aid is disclosed, which has different modes that have different dynamic ranges, such as a "sleep" mode, an "active" mode, and/or an "RF communication" mode.

The above paragraph is merely a general summary, and should not be construed as limiting in any way. More detail is provided in the figures and in the text that follows.

FIG. 1 is a block diagram of an implantable hearing restoration device 1, with arrows that trace the flow of acoustic signals. The acoustic signals flow from a sound environment 2, to an implantable hearing restoration device 1, to a patient anatomy 6.

The sound environment 2 may be the acoustic environment in which the patient and hearing device 1 exist, such as a quiet office, a busy street, or a soundproof booth that may be used for audiometric testing. The sound environment 2 may create sounds that are within the typical pressure and frequency range that a human with normal hearing can perceive. In general, a typical frequency range for normal human hearing may be between 20 Hz and 20 kHz, although the high-frequency edge of this range typically decreases with age. Note that the sound environment 2 may produce acoustic signals outside the frequency range of human hearing as well, although the implantable hearing restoration device 1 may be largely unaffected by these signals. Sounds produced by the sound environment 2 arrive at the implantable hearing restoration device 1 in the form of acoustic pressure waves.

The implantable hearing restoration device 1 may include three general units, including a sensor 3 or microphone 3, a processor 4 or amplifier 4, and a driver 5 or electrode 5. Note that the driver 5 may also be referred to as a transducer or a speaker.

The sensor 3 may be an element or transducer that converts mechanical or acoustic energy into an electrical signal, such as a microphone or piezoelectric sensor. The sensor 3 receives the sound produced by the sound environment 2 and converts it into an input electrical signal. For the purposes of this document, it is assumed that the input electrical signal may be generated in a known manner.

The processor 4 processes the input electrical signal from the sensor 3, and may amplify, filter and/or apply other linear and/or non-linear algorithms to the input electrical signal. The processor 4 produces an output electrical signal and sends it to the transducer 5. In general, much of the remainder of this document is directed to particular processing performed by the processor 4, and there is much more detail concerning the processor 4 in the text that follows.

The transducer 5 receives the output electrical signal from the processor 4 and converts it into a stimulation signal that can be received by the patient anatomy 6. Depending on the type of implantable hearing restoration device 1, such as a cochlear implant or middle ear device, the stimulation signal may be acoustic, mechanical and/or electrical in nature. For the purposes of this document, it is assumed that the stimulation signal may be received in a known manner.

Figure 2:
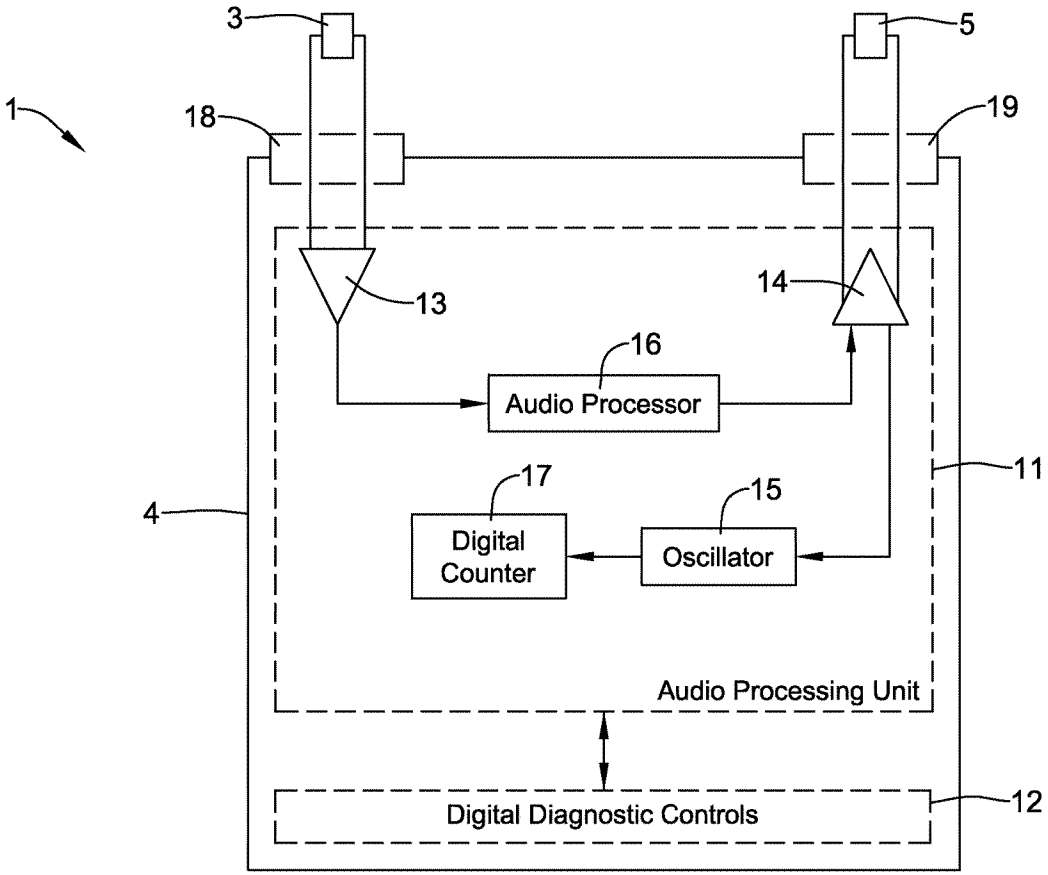
FIG. 2 is a schematic drawing of a sample implantable hearing restoration device having one oscillator and one digital counter.

FIG. 2 is a schematic drawing of a sample implantable hearing restoration device 1. In particular, the sample device 1 shows particular modules and elements that perform particular functions; it will be understood by one of ordinary skill in the art that the configuration of FIG. 2 is merely an example, and that other modules and elements may be used to perform the particular functions noted in detail below. In addition, although both the sensor 3 and the transducer 5 are shown in the example of FIG. 2 as being electrically capacitive in nature, it will be understood that other sensors and drivers may be used that need not be based on capacitance.

The sensor 3 electrically connects to the processor 4 through a transducer connection 18. The electrical signal produced by the sensor 3 enters an input amplifier 13. During normal use, the signal from the input amplifier 13 enters an audio processor 16, the signal from the audio processor 16 feeds an output amplifier 14, which in turn connects electrically through a transducer connection 19 to the transducer 5. Note that the day-to-day operation of the device 1 may use all-analog processing of the sound, rather than conversion to digital, processing in the digital domain, and conversion back to analog. The input amplifier 13, the audio processor 16 and the output amplifier 14 may be grouped collectively within an audio processing unit 11, although the individual components need not be physically grouped together in the same location on a circuit board or integrated circuit. The processor 4 includes a set of digital diagnostic controls 12 that can control the analog elements, and can control properties such as the gain, equalization, compression/limiting, and so forth.

The output amplifier 14 may have a primary output, which connects through transducer connection 19 to the transducer 5. In general, powering the primary output consumes more power than most or all of the other functions in the device 1. The output amplifier 14 may also produce a secondary output, which may be a scaled and/or summed replica of the primary output. The two outputs are related by a multiplicative factor, so that if one measures a quantity in one of the outputs, the corresponding quantity in the other output may be easily inferred. The two outputs may be created from closely matched transistors in the output stage of the amplifier 14.

The secondary output may be used for keeping track of the charge delivered to the transducer 5 and help infer the charge remaining in the battery. The current from the secondary output may be directed into an integrator, since the time integral of current is charge. In general, integrating circuits are well-known, and usually involve directing the input current to charge a capacitor. In many cases, the secondary output current may be made one-sided, rather than oscillatory about a zero point, by using a rectifier.

In the example device 1 shown in FIG. 2, the secondary output is directed to an element 15 denoted as an "oscillator". While element 15 is not a conventional oscillator that generates a sine wave with a known frequency, element 15 does show repeating behavior.

One may think of the oscillator 15 as a "storage bucket" for electrical charge. As secondary current from the output amplifier 14 enters the oscillator 15, the "bucket" fills up. When the "bucket" of charge is full, the charge is emptied and a digital pulse is sent to a digital counter 17. For each cycle of filling and emptying, the digital counter 17 is incremented. Eventually, the digital counter 17 reaches a predetermined threshold that indicates that the battery is low. Note that the oscillatory behavior of the oscillator 15 occurs from the cycle of filling and emptying of the incoming charge, and not from any predetermined circuitry that is designed to sinusoidally oscillate at a predetermined frequency. The frequency of the filling/emptying cycle may increase or decrease if the incoming current is increased or decreased, respectively.

The "size" of the "bucket" is the amount of charge that is filled and emptied in each cycle of the oscillator. Numerically, the amount of charge, Q [in coulombs], equals the product of C [in farads], the capacitance of the capacitor that is charged in the oscillator 15, and V [in volts], the threshold voltage that triggers the emptying of the "bucket". Once the "charge per bucket" Q is determined, it is straightforward to multiply it by the cumulative count tallied by the digital counter 17, and scale it by the ratio between the primary and secondary outputs of the output amplifier 14 to arrive at the total charge used from the battery. The percentage of battery charge remaining may be given by total charge of the battery divided by the charge capacity of the battery, subtracted from 100%.

Although the secondary current varies at typical acoustic frequencies, such as 20 Hz to 20 kHz, and varies in amplitude with the volume level of ambient sounds, we can perform simple rough calculations by approximating the secondary current with an average current, I [in amperes]. The average length of time, or period [in seconds], between charge/discharge cycles is given by the charge, Q [in coulombs], divided by the average current, I [in amperes], or, equivalently, C [in farads] times V [in volts] divided by I [in amperes]. Similarly, the average frequency [in Hz] of the oscillator is given by I [in amperes] divided by the product of C [in farads] and V [in volts].

Figure 3:
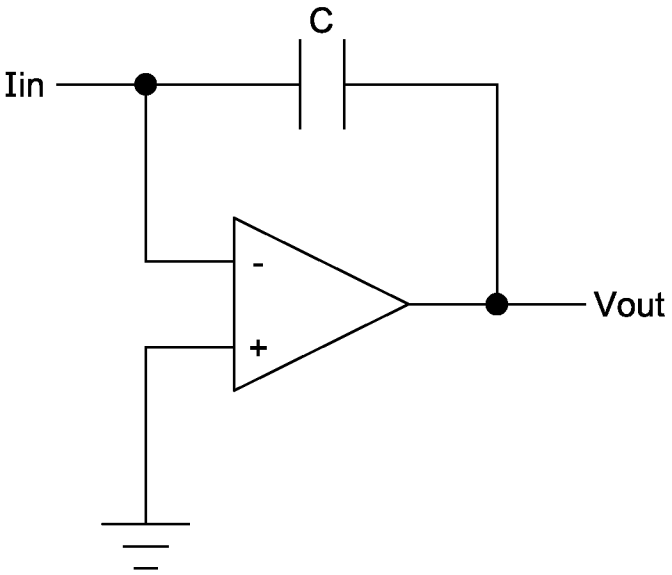
FIG. 3 is a sample circuit for a charge integrator.

A basic example circuit for the charge integrator is shown in FIG. 3. The change in voltage per time, the time derivative of the quantity $V_{out}$, is given by the quantity ($I_{in}$/C), where $I_{in}$ is the input current from the secondary current output of the output amplifier 14, and C is the capacitor that becomes charged and discharged each cycle. The circuit shown in FIG. 3 is just an example; other suitable circuits may be used as well.

Note that the electrical components for discharging the capacitor C are not shown in FIG. 3, but would be well-known for one of ordinary skill in the art. For instance, the charge integrator of FIG. 3 may include a switch at the top-left corner of the drawing, which can switch between charging current $I_{in}$, as is currently shown, and the output voltage $V_{out}$. In some cases, the capacitor C is completely discharged to 0 volts, and the discharging voltage would be ground. In other cases, the capacitor is only partially discharged to an intermediate voltage between 0 volts and the threshold voltage.

In most cases, the change in voltage per time is linear or close to linear. In other cases, there may be a non-linear component to the change in voltage per time, such as an asymptotic effect.

Note that the oscillator 15 and the digital counter 17 may together be referred to as a "coulomb counter".

Figure 4:
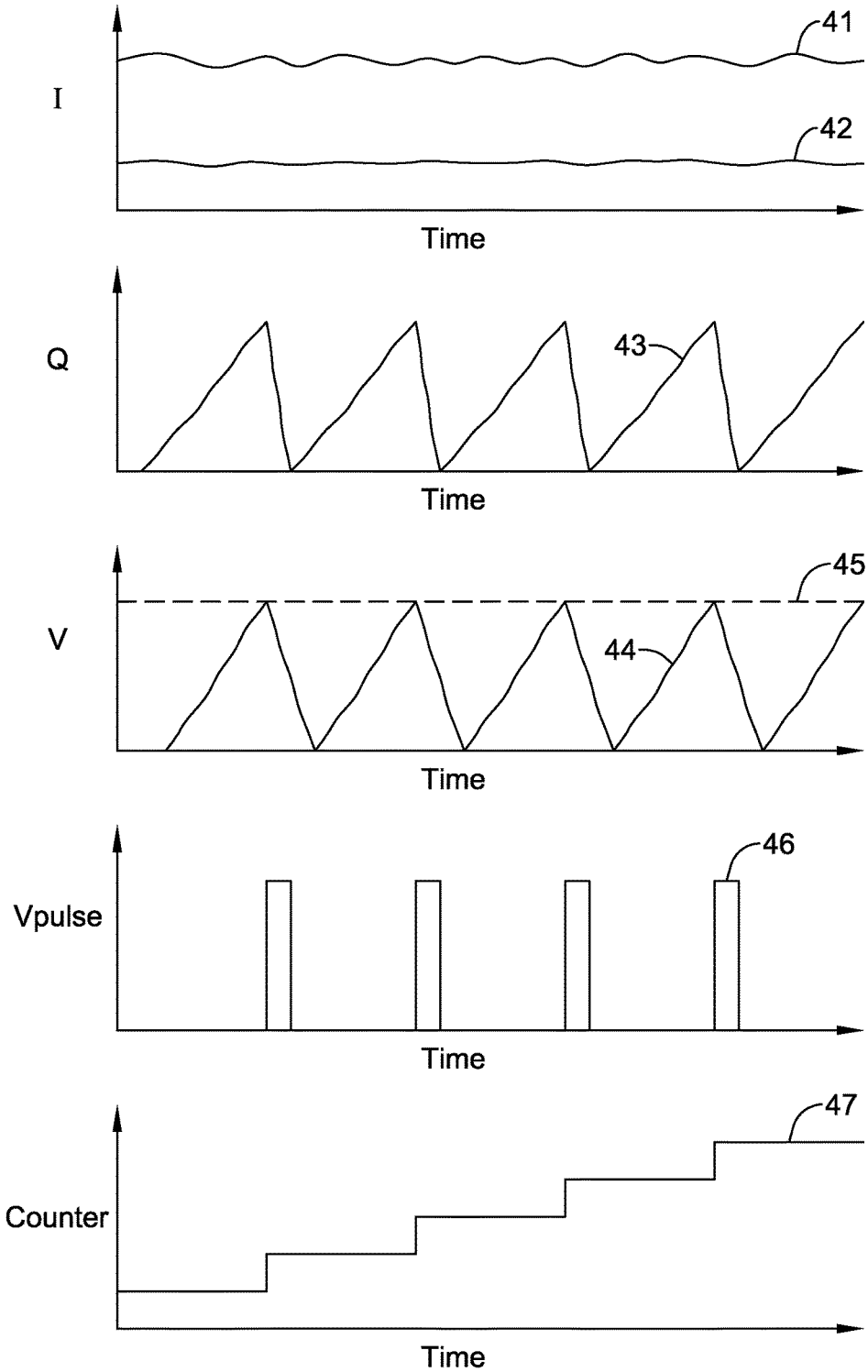
FIG. 4 is a series of plots of various electrical quantities over time for the device of FIG. 2.

FIG. 4 shows plots versus time of primary current 41, secondary current 42, charge 43 on the capacitor, voltage 44 across the capacitor, threshold voltage 45 at which discharging of the capacitor is triggered, pulse voltage 46, and digital counter level 47. FIG. 4 includes roughly four cycles of charging and discharging of the capacitor C.

The primary current 41 is the current from the primary output of the output amplifier 14. In practice, the primary current 41 includes many peaks and valleys, corresponding to sounds around the user. For simplicity, we draw primary current 41 as being roughly DC with some jaggedness, but it will be understood that the actual primary current 41 may look much more complicated.

The secondary current 42 is the current from the secondary output of the output amplifier 14, which is a scaled version of the primary current. In practice, the secondary current 42 may also be more complicated in appearance, much like the primary current 41. The secondary current 42 may vary from the primary current 41 by a multiplicative factor, such as 2, 3, 4, 5, 6, 7, 8, 9, 10, 20, 30, 40, 50, 60, 70, 80, 90, 100 or more than 100.

The charge 43 on the capacitor rises and falls as the capacitor is charged and discharged. In general, the charge 43 is a time integral of the secondary current 42, but with periodic discharging of the capacitor when the capacitor charge (or voltage) reaches a particular threshold. If the secondary current 42 increases or decreases, the local slope of the curve 43 increases or decreases, as well.

The voltage 44 across the capacitor tracks with the charge 43 on the capacitor, since the two are related by the relationship Q=CV, where Q is the charge on the capacitor, C is the capacitance of the capacitor, and V is the voltage across the capacitor.

When the voltage 44 across the capacitor reaches a threshold voltage 45, a switch is triggered that discharges the capacitor and generates a pulse 46 that is sent to the digital counter 17.

The slope of the curve for voltage 44, in the charging sections, is given by the quantity (I/C), as noted above. In general, the capacitor may be discharged relatively quickly, and the downward slope of the curve for voltage 44, in the discharging sections, may be relatively steep.

Note that during the charging phase of each cycle, the voltage across the capacitor may increase generally linearly. Note also that true linearity would only occur if the secondary current were constant. For the purposes of this document, even though the secondary current varies with an acoustically-generated signal, and the voltage across the capacitor varies as a time-integral of such a signal, we shall refer to the voltage across the capacitor as increasing "generally" linearly.

For the pulse voltage 46, the pulse duration and the particular voltage used for the pulse may vary as needed, in order to reliably trigger the digital counter 17.

The level 47 of the digital counter 17 is shown to increase with each received pulse. In practice, the level 47 may not be an analog voltage, but may be a digital representation of an incremented value. Such digital counters are well-known to one of ordinary skill in the art. It is assumed that the digital counter includes enough bits in its digital representation to adequately count to the upper end of the lifetime of the battery. It is also assumed that the time between pulses is short enough so that the battery would not run out of charge between pulses.

There may be advantages to using a scaled secondary output from the output amplifier 14, rather than using the primary output. For instance, at loud volumes, when the most current is drawn in the primary output, there may be excessive power dissipated by the resistor in series with the battery terminal. Such a power dissipation issue is relieved by using a scaled version of the primary output, which is the secondary output.

In some cases, the device 1 keeps track of the amounts of time spent in each of its operational modes from the time of battery attachment or battery recharge, to an end of service. Along with the count from the digital counter 17, these amounts of time may provide an accurate state of charge indicator.

In some cases, the device 1 includes a system watchdog that periodically polls the battery management system. In some of these cases, if the remaining battery charge crosses a particular predetermined threshold, the system watchdog deems that the battery capacity is low and alerts the wearer of the device with an audible alert. In some others of these cases, if the battery discharge rate exceeds more than a predetermined threshold, the device 1 alerts the wearer with an audible alert to see the clinician and determine if the device has had a failure condition or undesired performance. In still others of these cases, the system watchdog keeps track of the number of telemetry events that the device has responded to, and alerts the wearer or clinician of a predetermined threshold has been exceeded.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a," "an," and "the" include plural referents unless the content clearly dictates otherwise. As used in this specification and the appended claims, the term "or" is generally employed in its sense including "and/or" unless the content clearly dictates otherwise.

The preceding detailed description should be read with reference to the drawings in which similar elements in different drawings are numbered the same. The drawings, which are not necessarily to scale, depict illustrative embodiments and are not intended to limit the scope of the invention.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A hearing aid for a patient, comprising:

a sensor that converts ambient sound around the patient into an input electrical signal;

an output amplifier that produces a primary output electrical signal in response to the input electrical signal and simultaneously produces a secondary output electrical signal that is a scaled version of the primary output electrical signal;

a driver that receives the primary output electrical signal and stimulates an anatomy of the patient;

an oscillator that receives the secondary output electrical signal and oscillates each time that a predetermined amount of electrical charge is received in the secondary output electrical signal; and a digital counter that increments each time the oscillator oscillates, wherein the secondary output electrical signal charges a capacitor and increases a voltage across the capacitor; and wherein when the voltage exceeds a predetermined threshold, the digital counter is incremented and the capacitor is discharged, wherein the digital counter tallies the number of charge/discharge cycles of the capacitor; and wherein when the digital counter reaches a predetermined count, the hearing aid indicates that its battery is running low.

2. The hearing aid of claim 1, wherein the secondary output electrical signal includes a rectifier that ensures that the secondary output electrical signal is one-sided.

3. The hearing aid of claim 1, wherein during the each charging phase of the capacitor, the voltage across the capacitor increases generally linearly.

4. The hearing aid of claim 3, wherein the predetermined threshold for voltage is sufficiently low to avoid roll-off behavior from the capacitor.

5. The hearing aid of claim 1 wherein the capacitor is fully discharged to ground for each charge/discharge cycle.

6. The hearing aid of claim 1 wherein the capacitor is partially discharged to a voltage greater than ground for each charge/discharge cycle.

7. The hearing aid of claim 1, wherein the secondary output electrical signal is received by only one oscillator and one digital counter.

8. The hearing aid of claim 1, wherein the secondary output electrical signal is switchably received by more than one oscillator and more than one digital counter.

9. The hearing aid of claim 8, wherein the hearing aid includes more than one operational mode; and wherein the operational modes all use the same oscillator and digital counter.

10. The hearing aid of claim 8, wherein the hearing aid includes more than one operational mode; and wherein each operational mode has a corresponding oscillator and a corresponding digital counter.

11. The hearing aid of claim 10, wherein each oscillator includes a resistor that is matched to typical current levels encountered in the corresponding mode.

12. The hearing aid of claim 10, wherein the operational modes include active, sleep and/or RF communication.

13. The hearing aid of claim 1, wherein if a periodic poll determines that a battery of the hearing aid has a remaining charge that is below a predetermined threshold, the driver alerts the patient with an audible signal.

14. The hearing aid of claim 1, wherein if a periodic poll determines that a discharge rate of a battery of the hearing aid exceeds a predetermined threshold, the driver alerts the patient with an audible signal.

15. The hearing aid of claim 1, wherein if a periodic poll determines that a hearing aid has undergone a number of telemetry events that exceeds a predetermined threshold, the driver alerts the patient with an audible signal.

* * * * *